US006752642B2

(12) United States Patent
Ushiro et al.

(10) Patent No.: US 6,752,642 B2
(45) Date of Patent: Jun. 22, 2004

(54) CONNECTOR WITH RETAINER MEMBERS TO BE ATTACHED TO A PANEL, METHOD OF ATTACHING THE CONNECTOR TO THE PANEL, AND METHOD OF COUPLING THE CONNECTOR WITH ANOTHER CONNECTOR

(75) Inventors: Yutaka Ushiro, Yokohama (JP); Katsuyuki Masaki, Yokohama (JP); Yusuke Hamada, Yokohama (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/327,898

(22) Filed: Dec. 26, 2002

(65) Prior Publication Data

US 2003/0124896 A1 Jul. 3, 2003

(30) Foreign Application Priority Data

Dec. 28, 2001 (JP) ..... 2001-402065

(51) Int. Cl.[7] ..... H01R 13/64

(52) U.S. Cl. ..... 439/248; 439/549; 439/555; 439/557; 439/569; 439/282; 439/296; 439/345; 439/377; 439/575

(58) Field of Search ..... 439/248, 549, 439/555, 557, 569, 282, 296, 345, 377, 575

(56) References Cited

U.S. PATENT DOCUMENTS 4,812,133 A * 3/1989 Fleak et al. ..... 439/248
5,263,871 A * 11/1993 Sano ..... 439/157
5,575,673 A * 11/1996 Dahlem et al. ..... 439/248
5,860,823 A * 1/1999 Samejima et al. ..... 439/248
5,904,441 A * 5/1999 Kodama et al. ..... 403/337
6,102,732 A * 8/2000 Seko et al. ..... 439/489
6,137,056 A * 10/2000 Miyazaki ..... 174/78

FOREIGN PATENT DOCUMENTS

JP 6-163125 6/1994
JP 10-189181 7/1998

* cited by examiner

*Primary Examiner*—Anthony Dinkins
*Assistant Examiner*—Anton Harris
(74) *Attorney, Agent, or Firm*—Armstrong, Kratz, Quintos, Hanson & Brooks, LLP

(57) ABSTRACT

A connector with retainer members which is not broken even if elastic retainer pieces of the retainer members are excessively bent when the connector is attached to a panel. The connector with retainer members comprises an insulating housing proper having penetration holes inside thereof through which a plurality of connector terminals are fitted therein, flanges protruded outwardly from right and left or upper and lower wall faces of the housing proper in a direction orthogonal to a direction of insertion and removal of the connector, a pair of retainer members having elasticity and fixedly attached to both sides of the back face of the flanges. The retainer members comprise posts fixedly attached to the flanges, and elastic retainer pieces having flexibility and formed by folding back the posts in a substantially inverted V-shape from each head thereof, and said elastic retainer pieces comprise retainer stepped parts at tip ends engaged with peripheral edges of attachment ports of a panel, and tongue pieces provided on the tip end of the retainer stepped parts and the tip ends of the tongue pieces are butted against the posts for restricting the elastic retainer pieces from being excessively bent.

9 Claims, 8 Drawing Sheets

CONNECTOR WITH RETAINER MEMBERS TO BE ATTACHED TO A PANEL, METHOD OF ATTACHING THE CONNECTOR TO THE PANEL, AND METHOD OF COUPLING THE CONNECTOR WITH ANOTHER CONNECTOR

FIELD OF THE INVENTION

The invention relates to a connector with retainer members to be attached to a panel, particularly to an improvement of retainer members, a connector with the improved retainer members, a method of attaching the connector to a panel, and a method of coupling the connector with the panel attached by the method of attachment with a connector fixedly attached to another panel.

BACKGROUND OF THE INVENTION

Electronic circuits constituting most electronic equipment are mounted on a printed panel or the like and divided into a plurality of units, and the respective units are coupled with one another by connecters for attachment to a panel and electrically connected thereto. A large connector has been generally used as the connector of this type for attachment to a panel, and most of the connectors are screwed in the foregoing panel or in a panel such as a chassis of an equipment, or the like by screws. However, as electronic equipment has been recently making a progress in miniaturization, the number of electronic components is reduced and assembly work of equipment is made more efficient so that a panel unit has been downsized, and a removable connector which can be coupled with these panels through one-touch operation has been used.

Meanwhile, when the connectors with panels are coupled with each other, there was a case where these connectors with panels are not smoothly coupled with each other due to occurrence of positional slight displacement between the connectors because of error in designing or manufacturing or error in attachment of the connectors to the panels or the like. When both the connectors are forced to be coupled with each other while the positional displacement still occurs, an excessive stress is applied to legs of contacts of the connectors, which causes a problem in that the contacts are removed from housings or the contacts are subject to permanent deformation or breakage trouble. There are provided various proposals for previously preventing such a permanent deformation, breakage trouble of the contact or the like.

There is known a method of coupling connectors fitted in panels with each other by screws which is, for example, disclosed in FIGS. 7(A) to 7(D). FIG. 7(A) is a plan view of a receptacle-type connector, FIG. 7(B) is a sectional view showing a state where the connector shown in FIG. 7(A) is screwed at one end by a screw, FIG. 7(C) is a plug-type connector, and FIG. 7(D) a sectional view showing a state where the connector shown in FIG. 7(C) is screwed at one end by a screw.

Connectors 100, 200 are structured such that a pair of flanges 102*a*, 102*b*; 202*a*, 202*b* formed respectively in housing propers 101, 201 are fixedly attached to panels 110, 210 by bolts 120*a*, 120*b*; 220*a*, 220*b*.

The receptacle-type connector 100 is structured such that diameters of attachment ports 103*a*, 103*b* provided in the flanges 102*a*, 102*b* are set to be substantially the same as diameters of the screw parts 122*a*, 122*b* of the bolts 120*a*, 120*b*, and the bolts 120*a*, 120*b* are inserted into the attachment ports 103*a*, 103*b* so that the bolts 120*a*, 120*b* are screwed in female screws 111*a*, 111*b* which are bored in the panel 110 or by nuts (not shown), and hence the receptacle-type connector 100 is fixedly attached to the panel 110. FIG. 7(B) shows a state where one flange 102*b* is attached to the panel 110 by the bolt 120*b*. The other flange 102*a* is attached to the panel 110 by the bolt 120*a* in the same state as shown in FIG. 7(B).

The other plug-type connector 200 is structured such that diameters of attachment ports 203*a*, 203*b* provided in the flanges 202*a*, 202*b* are set to be slightly larger than diameters of the screw parts 222*a*, 222*b* of the bolts 220*a*, 220*b* but smaller than diameters of heads 221*a*, 221*b*, of the bolts 220*a*, 220*b*. The bolts 220*a*, 220*b* are inserted into the attachment ports 203*a*, 203*b*, so that the bolts 220*a*, 220*b* are screwed in female screws which are bored in the panel 210 or by nuts (not shown) in the same manner as the above mentioned attachment method, and hence the plug-type connector 200 is fixedly attached to the panel 210. Stepped screws are normally used as the bolts, and a predetermined gap is defined between shanks of the bolts and the panel in a state where the bolts are attached to the panel, wherein a part of the flange 202*b* is movable in the gap. This state is shown in FIG. 7(D). The other screw 220*a* is attached to the panel 210 in the same state as shown in FIG. 7(D).

In cases where the connectors 100, 200 attached to the panels 110, 210 are coupled with each other with this attachment method, if there occurs positional displacement by a distance d therebetween, each part of the flanges of the connector 200 is moved in the attachment ports 203*a*, 203*b*, thereby adjusting the positional displacement. According to the adjustment method of positional displacement, if the positional displacement occurs, the adjustment is made by loosening screws every time the positional displacement occurs, causing a very trouble adjusting operation.

On the other hand, the method of coupling connectors with detachable retainer members with a panel is, for example, proposed by JP-A 10-189181, 6-163125 which are known.

FIG. 8 shows a panel versus panel type connector system disclosed in JP-A 10-189181, and it is a sectional view showing a state where a respective connectors are coupled with each other.

The panel versus panel type connector system comprises a first connector 300 and a second connector 400 fitted in a pair of panels 310, 410, respectively, in a stacked state, wherein contacts fitted to both the first connector and the second connector are connected to terminals of electronic components (not shown), respectively, on the respective panel surfaces by solder. The first connector 300 comprises housings 300*a*, 300*b* having recessed part 302 for receiving the second connector 400, and a contact 301 fixedly attached to the housing 300 whereas the contact 301 comprises a barrel part 301*a* for contacting a contact of the second connector 400 and a leg part 301*b* extending outwards at the bottom side of the housing 300. The housing 300 is divided into two parts, i.e., the housings 300*a*, 300*b*, and a slit 304 is defined between the both housings 300*a*, 300*b*, wherein both the housings 300*a*, 300*b* are coupled with each other by the barrel part 301*a* and a bridge part (not shown) of the contact.

When the first and second connectors 300 and 400 are coupled with each other, the barrel part 301*a* of the contact is caused to undergo flexure at the slit 304 in all directions without being restricted by the housing 300*b* because the housings 300*a*, 300*b* are coupled with each other by the barrel part 301*a* and the bridge part by way of the slit 304.

As a result, the housing 300*a* located at a side of the opening of the recessed part 302 can be deformed relative to the housing 300*b* located at a side of the panel in a rotating direction and another direction in plane parallel with the panel, thereby improving a following function.

A connector disclosed in the JP-A 6-163125 and shown in FIG. 9 comprises a housing 500 having a plurality of insertion holes 510 which are provided by boring the housing 500 through which posts 505 are inserted, a contact 520 formed of contact spring pieces 520*a* which are pressed into the insertion holes 510 through the lower face of the housing 500 and fixedly attached thereto, an inverted U-shaped spring pieces 520*b* of the contact continuously connected to the lower end of the contact spring pieces at one end and disposed outside the housing, and terminals 520*c* continuously connected to the other end of the inverted U-shaped spring pieces 520*b* and fixedly attached to a print panel by solder, and metal fittings fixedly attached to the print panel for restricting an upward movement of the housing.

If there occurs positional displacement, when coupling with the connector to another connector, the housing 500 is moved towards a side by causing the inverted U-shaped spring pieces 520*a* of the contact to undergo flexure to absorb the positional displacement, so that positional alignment between positions of the posts 505 and insertion holes 510 of the housing and smooth insertion and coupling between the posts and the housing can be effected.

The connectors have to be moved to a predetermined position in the case of employment of screws for attaching connectors to the panels so as to correct the positional displacement which occurs when the connectors to be attached to the panels are coupled with each other. Accordingly, when the connectors are fixedly attached to the panels by screws, bolts and nuts are required, causing a problem in that the number of components increases and attaching and removing operations are troublesome.

On the other hand, the panel versus panel type connector system disclosed in the JP-A 10-189181, and the JP-A 6-163125 automatically absorbs the positional displacement which occurs when connectors are coupled with each other.

However, with the structure of the former connectors, the connectors to be fitted in each panel are restricted, and this structure can be applied neither to a plug-type connector on which a plurality of plug pins are embedded nor to a receptacle-type connector having a contact into which the plurality of plug pins are inserted. In this respect, the latter connector is made up of a connector having plug pins and a contact through which the plug pins are inserted, however, the contact is made up of contact spring pieces with inverted U-shaped spring pieces, and hence this connector has a specific structure. Accordingly, it is necessary to design a connector housing and contact terminals in specific shape. As a result, the panel versus panel type connector system connector can not employ an ordinary plug-type connector and a receptacle-type connector.

The invention has been focused on solving the foregoing problems and it is an object of the invention to provide a connector with retainer members which is not broken even if elastic retainer pieces of retainer members are excessively bent when it is attached to a panel.

It is another object of the invention to provide a connector with retainer members capable of preventing elastic retainer pieces of retainer members from being subject to inadvertent stress so that retention between a panel and the connector is maintained, and permanent deformation or breakage of the elastic retainer piece does not occur.

It is further object of the invention to provide a method of attaching a connector with retainer members to a panel while ensuring a strength and a stability of the connector not to be removed from the panel.

It is still further object of the invention to provide a method of coupling a connector to another connector fixedly attached to another panel or the like without laboring by automatically adjusting an error of an attachment position which occurs between both connectors, when the connector is coupled with another connector.

SUMMARY OF THE INVENTION

The above objects of the invention can be achieved by following means.

The connector with retainer members to be attached to a panel according to first to third aspects of the invention comprises an insulating housing proper having penetration holes inside thereof through which a plurality of connector terminals are fitted therein, flanges protruded outwardly from right and left or upper and lower wall faces of the housing proper in a direction orthogonal to a direction of insertion and removal of the connector, a pair of retainer members having elasticity and fixedly attached to the flanges on both sides of the back faces as the flanges, characterized in that the retainer members comprise posts fixedly attached to the flanges, and elastic retainer pieces having flexibility and formed by folding back the posts in an inverted V-shape from each head thereof, and the elastic retainer pieces comprise retainer stepped parts at tip ends engaged with peripheral edges of attachment ports of a panel, and tongue pieces provided on the tip end of the retainer stepped parts and tip ends of the tongue pieces are butted against the posts for restricting the elastic retainer pieces from being excessively bent.

According to the connector set forth above, when the retainer members are inserted into the attachment ports of the panel, the elastic retainer pieces are bent towards the posts. However, when the elastic retainer pieces are excessively bent, they are prone to be folded down and broken at the connecting spot between themselves and the post, but the tongue pieces are butted against the surfaces of the posts and restricted in bending before the elastic retainer pieces are excessively bent, so that the elastic retainer pieces are prevented from being broken.

The retainer members are preferably structured to be made up of retainer bases comprising lock grooves having diameters which are smaller than those of attachment ports of the panel and widths which are wider than a thickness of the panel, and retainer stepped parts of the elastic retainer pieces, respectively at fixed roots of the flanges.

With the structure set forth above, since the peripheral diameter of the retainer base formed on the each root of the retainer members is smaller than the diameter of the attachment port of the panel, the retainer members can be freely engaged in the attachment port by the interval corresponding to the difference in the diameters in the peripheral external direction.

The retainer members are fixedly attached to the flanges in a manner that the elastic retainer pieces face each other while the posts sandwich the housing proper therebetween.

Since the elastic retainer pieces are fixedly attached to the flanges while facing each other, if a foreign matter impinges against the retainer members from an outside, the foreign matter can be received by the posts, and it does not reach the elastic retainer pieces. As a result, it is possible to prevent the occurrence of the case where the elastic retainer pieces are pressed when the foreign matter impinges against the retainer members, thereby preventing the retainer stepped parts from being removed from the peripheral edge of the attachment port of the panel.

The method for attaching a connector with retainer members to be attached to a panel to another panel according to the fourth aspect of the invention comprises the steps of preparing the connector as in any of the first to third aspects of the invention, and a panel having attachment ports slightly larger than a diameter of an outer periphery of the retainer members of the connector; characterized in that when the retainer members are inserted into the attachment ports of the panel against the urging of elastic force thereof, the retainer bases of the retainer members are freely engaged in the attachment ports of the panel, whereby the retainer bases are engaged with peripheral edges of the attachment ports of the panel at stepped parts of the lock groove walls and stepped parts of the elastic retainer pieces.

Since the peripheral diameter of the retainer bases formed in the roots of the retainer members is smaller than the diameter of the attachment ports of the panel, the retainer members are freely engaged in the attachment ports by the difference in diameters thereof in a peripheral external direction. In a normal attaching state, the retainer bases are engaged with peripheral edges of the attachment ports of the panel at the stepped parts of the lock grooves and the stepped parts of the elastic retainer pieces, so that even if the retainer bases are moved in the attachment ports and engagement areas of the stepped parts relative to the panel are reduced, the stepped parts are engaged with the attachment ports by the amount of reduction of the engagement areas, and hence the stepped parts are retained by the panel while they are complemented with each other.

A method of coupling a connector attached to a panel by the method according to the fifth aspect of the invention to another connector fixedly attached to another panel as in the fourth aspect of the invention, is characterized in that in cases where positional displacement occurs between both connectors when both connectors are coupled with each other, the connector is coupled with another connector fixedly attached to another panel in a state where the retainer bases of the connector are freely engaged in the attachment ports of the panel, so that the retainer bases are movable in the attachment port by an interval corresponding to a difference in diameter between the attachment port of the panel and the outer periphery of the retainer bases, thereby absorbing the positional displacement between both connectors.

If there occurs a positional displacement when both connectors are coupled with each other, the connector housing is induced in the opening of the other connector, and it moves by the amount of positional displacement to be corrected in an ordinary state so that both the connectors are coupled with each other.

BRIEF DESCRIPTION OF THE DRAWINGS

FIGS. 1(A) to (D) show a connector with retainer members according to an embodiment of the invention, wherein FIG. 1(A) is a plan view of the connector, FIG. 1(B) is a front view thereof, FIG. 1(C) is a rear view thereof, and FIG. 1(D) is a bottom view thereof;

FIGS. 2(A) and 2(B) show the connector in FIG. 1(A), wherein FIG. 2(A) is a sectional view taken along the arrow A—A in FIG. 1(A), and FIG. 2(B) is a side view of the connector as seen from the arrow B—B in FIG. 1(A);

FIGS. 5(A) to 5(C) are views each showing a state where the typical retainer member in FIGS. 1(A) to 1(D) is fitted in the panel, wherein FIG. 5(A) is a sectional view showing the state during the insertion of the retainer member into the panel, FIG. 5(B) is a sectional view showing the state of the retainer member immediately after it is inserted into the panel, and FIG. 5(C) is a sectional view showing the state where the retainer member is moved after it was attached to the panel;

FIGS. 6(A) to 6(C) are views each showing a positional relationship in a coupling state between the connector according to the embodiment of the invention and another connector, wherein FIG. 6(A) is a plan view of the positional relationship in a normal state where positional displacement does not occur, FIG. 6(B) is a plan view of the positional relationship in a state where the positional displacement occurs, and FIG. 6(C) is a plan view showing a state where the positional displacement is absorbed;

FIGS. 7(A) to 7(D) are views each showing a conventional method of coupling connectors which are fitted in panels, respectively, wherein FIG. 7(A) is a plan view of a receptacle-type connector, FIG. 7(B) is a sectional view showing a state where the connector in FIG. 7(A) is screwed in the panel at one end by a screw, FIG. 7(C) is a plan view of a plug-type connector, and FIG. 7(D) a sectional view showing a state where the connector in FIG. 7(C) is screwed in the panel at one end by a screw.

PREFERRED EMBODIMENT OF THE INVENTION

An embodiment of the invention is described with reference to the attached drawings. The invention is not limited to the embodiment set forth hereunder, and can be modified by a method described hereinafter, and the structure and function of the modified part can be easily understood and conjectured from the description of the embodiment, and hence the description thereof is omitted.

Figure 1A:
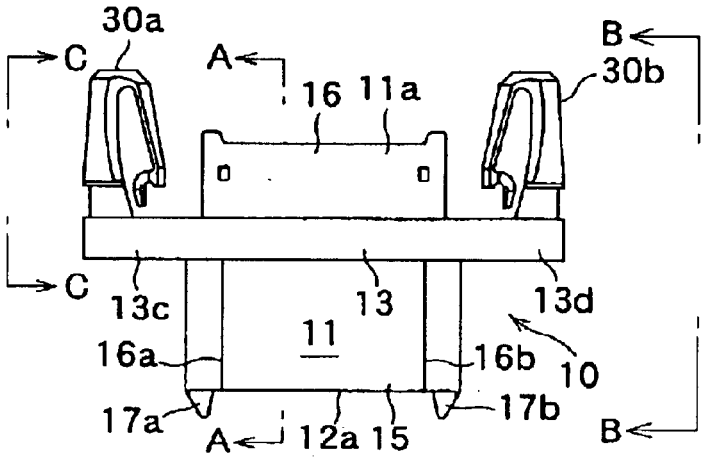
Figure 1B:
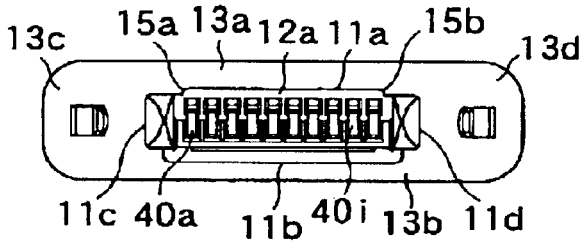
Figure 1C:
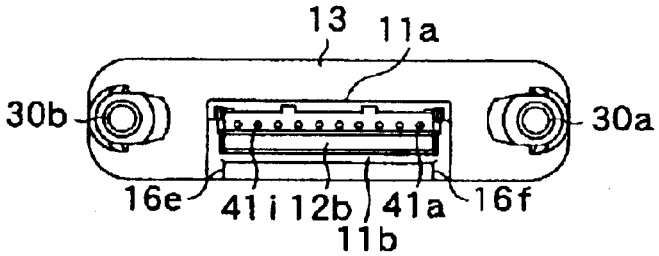
Figure 1D:
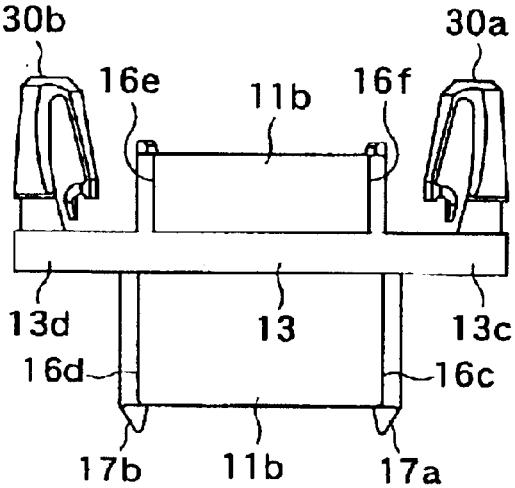
Figure 2A:
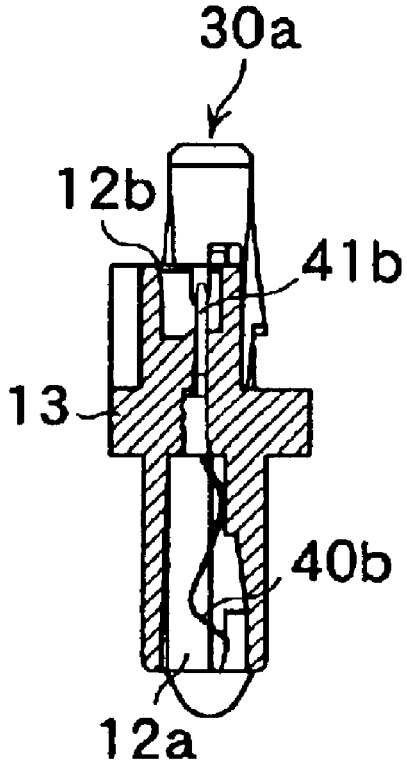
Figure 2B:
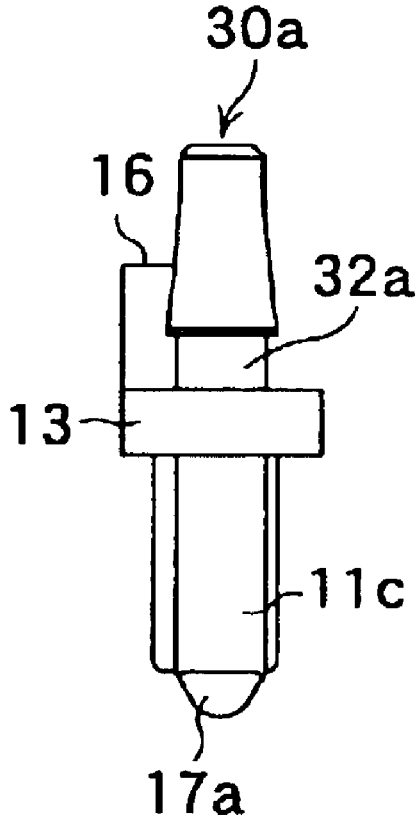

FIGS. 1(A) to 1(D) show a connector with retainer members according to an embodiment of the invention, wherein FIG. 1(A) is a plan view of the connector, FIG. 1(B) is a front view thereof, FIG. 1(C) is a rear view thereof, and FIG. 1(D) is a bottom view thereof, and FIGS. 2(A) and 2(B) show the connector in FIGS. 1(A) to 1(D), wherein FIG. 2(A) is a sectional view taken along the arrow A—A in FIG. 1(A), and FIG. 2(B) is a side view of the connector as seen from the direction of the arrow B—B in FIG. 1(A).

Although the embodiment of the invention is described with reference to a receptacle-type connector, the invention is not limited to this receptacle-type connector but can be applicable to a plug-type connector.

A receptacle 10 is made up of a housing in flat block shape, namely, a housing proper 11 comprises upper and lower walls 11*a*, 11*b*, left and right sidewalls 11*c*, 11*d*, slender openings 12*a*, 12*b* which are surrounded by the respective walls and in which terminals are fitted, flanges 13

(13*a* to 13*d*) which are provided on the respective walls orthogonal to a direction of insertion and removal of the connector, and protruded outwardly, and a pair of retainer members 30*a*, 30*b* which fixedly attached to the back face of the flanges 13*c*, 13*d* which are extended from both sidewalls of the housing, and are fixed thereto wherein these components are formed of an insulating synthetic resin material.

The housing proper 11 is divided at the flange 13, as the boundary, into a front housing 15 and a back housing 16 which are extended forward and backward, wherein the front housing 15 is formed to be slightly longer than the back housing 16. The front housing 15 comprises the upper and lower walls 11*a*, 11*b*, left and right sidewalls 11*c*, 11*d*, the slender opening 12*a* which is surrounded by these walls, into which a plug, described later, can be inserted and in which a plurality of connector terminals are fitted, pyramidal parts 17*a*, 17*b* which are provided at the edge of the opening at the left and right sidewalls 11*c*, 11*d*, and stepped parts 16*a*, 16*b* which are respectively provided at both ends of the upper wall 11*a*. Both the pyramidal parts 17*a*, 17*b* and the stepped parts 16*a*, 16*b* fulfill insertion guiding function to effect smooth coupling between a receptacle and a plug when the receptacle and the plug are connected to each other. The opening 12*a* has a plurality of partition walls provided inside thereof in a predetermined spacing, and connector terminals 40*a* to 40*i* fitted between the partition walls.

On the other hand, the back housing 16 comprises upper and lower walls 11*a*, 11*b*, left and right sidewalls 11*c*, 11*d* which are extended backward from the front housing 15, and a slender opening 12*b* which are surrounded by respective walls in which a plurality of connector terminals are fitted, when the connector is inserted into and connected to the housing 16, and stepped parts 16*e*, 16*f* which are provided at both ends of the lower wall faces respectively.

A plurality of plug pins 41*a* to 41*i* connected to the connector terminals are embedded between the partition walls provided in the innermost part of the opening 12*b* and other connectors (not shown) are connected to these plug pins 41*a* to 41*i*. The connector terminals 40*a* to 40*i* comprise the wave-like bent and stripped elastic contact pieces and pin-like terminals coupled with the contact pieces. FIG. 2(A) shows the wave-like bent and stripped elastic contact piece of one connector terminal 40*b* and the pin-like terminal 41*b* connected to the connector terminal 40*b*.

The flanges 13 comprise upper and lower walls 13*a* to 13*b* which protrude up and down orthogonal to a direction of insertion and removal of the connector and left and right sidewalls 13*c*, 13*d* which protrude left and right, wherein surface of flanges at both sidewalls are formed such that they have wider areas so as to form the retainer members 30*a*, 30*b*, and the retainer members 30*a*, 30*b* are formed at the left and right sidewalls 13*c*, 13*d* on the backside of the flange 13, whereby the retainer members 30*a*, 30*b* are integrally formed with the flange 13 such that the upper and lower walls 13*a* to 13*b*, left and right sidewalls 13*c*, 13*d* become flush with each other in a predetermined thickness when the housing is made up.

The respective retainer members 30*a*, 30*b* are tapered on their heads to form a substantially conical shape in an external shape so that they can be easily inserted into attachment ports of the panel. Both the retainer members 30*a*, 30*b* have the same structure and function. For brevity in description to be well understood, both the retainer members 30*a* and 30*b* are collectively represented and depicted by one retainer member 30, which is substituted by both the retainer members 30*a* and 30*b* by depicting identical number with suffixes a, b.

Figure 3:
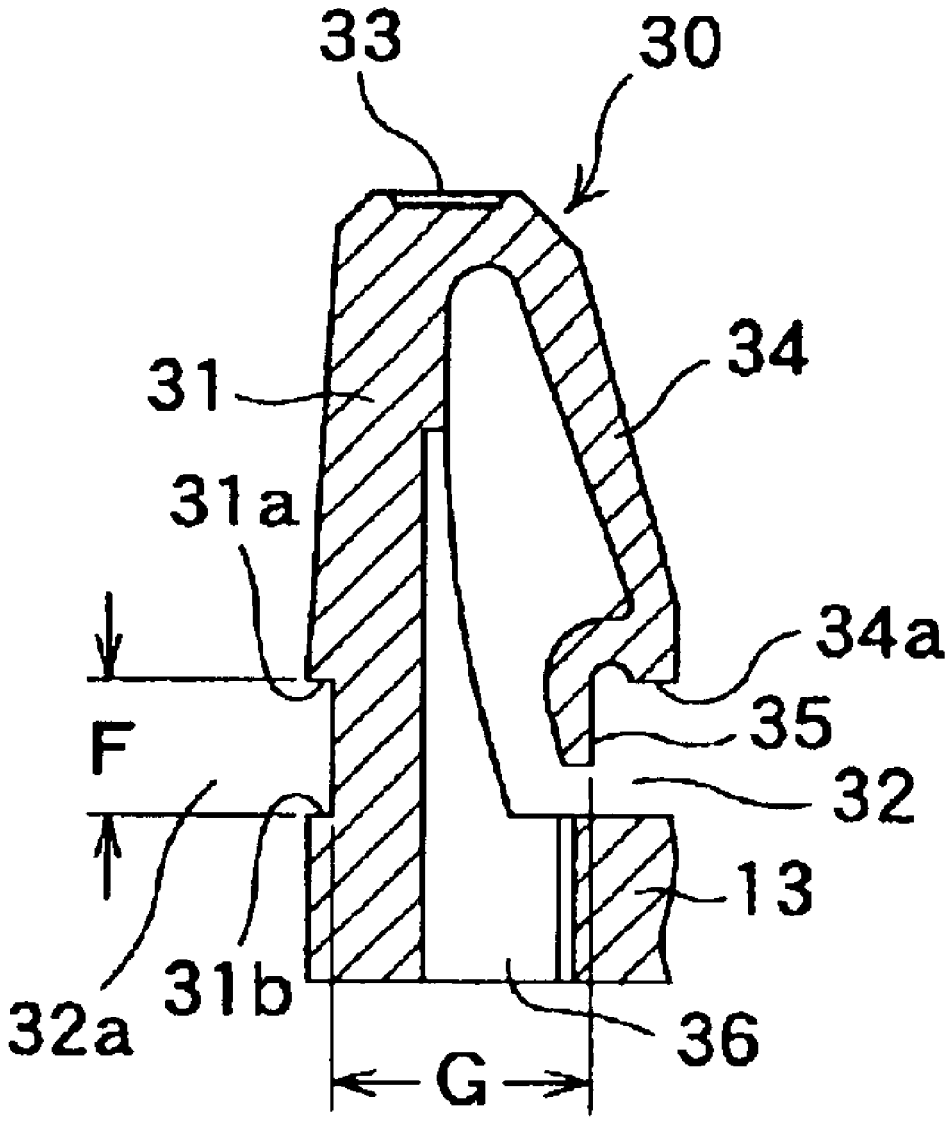
FIG. 3 shows a typical retainer member shown in FIGS. 1(A) to (D), and it is a sectional view taken along the arrow C—C in FIG. 1(A)

FIG. 3 shows one typical retainer member 30, and it is a sectional view taken along the line C—C in FIG. 1(A).

The retainer member 30 has substantially a hook shape, or, a jogged shape, in an external shape in the plan view of FIG. 1(A) and also hook shape or jogged shape in its sectional view in FIG. 3.

The retainer member 30 comprises a post 31 protruding from the back face of the flange and a flexible elastic retainer piece 34 which is bent at a top 33 thereof in a substantially inverted V-shape. The post 31 and the elastic retainer piece 34 are pointed at their tip ends and outer surfaces thereof are curbed in a circular arc. The root of the post 31 is integrally formed with the back wall surface of the flange 13, and it is formed slightly smaller as it remotes from the root. The post 31 has a recessed lock groove 32*a* which is engaged with a peripheral edge of an attachment port (described later) of a panel at an outer peripheral surface of the root. The lock groove 32*a* has stepped parts 31*a*, 31*b* at both sides wherein one stepped part 31*b* is flush with the back face of the flange 13 while the other stepped part 31*a* is provided at a position where it has a width which is slightly wider than the thickness of a panel.

The elastic retainer piece 34 is made up of a curbed thin plate piece and is bent substantially in inverted V-shape while it is folded back from the top 33 of the post 31, and it has flexibility. The tip end of the elastic retainer piece 34 is not fixedly attached to the back face of the flange to form a free end. The free end of the elastic retainer piece 34 has a retainer stepped part 34*a* which is provided at the tip end of the elastic retainer piece 34, and retained by the face of a panel while directing toward the post 31, and a tongue piece 35 which is provided at the tip end of the retainer stepped part 34*a* for restricting the elastic retainer piece 34 from being excessively bent.

The position of the retainer stepped part 34*a* is remote from the back face of the flanges 13 and spaced by a gap F which is slightly larger than the thickness of the panel. The tongue piece 35 is structured such that the elastic retainer piece 34 is bent toward the post 31 when the retainer member 30 is inserted into the attachment port of the panel, however if the elastic retainer piece 34 is excessively bent towards the post 31, it is prone to be damaged at a part where the elastic retainer piece 34 is connected with the post 31. The tongue piece 35 is butted against the surface of the tongue piece 35 before the elastic retainer piece 34 is excessively bent, thereby restricting the elastic retainer piece 34 from being excessively bent to prevent the damage of the elastic retainer piece 34.

The post 31 has a retainer base 32 at its root which is formed of a recessed lock groove 32*a*, and the retainer stepped part 31*a*, 31*b*. The retainer base 32 is freely engaged in the attachment port of the panel when the retainer member 30 is inserted into the attachment port of the panel, and the stepped part 34*a* of the elastic retainer piece 34 or both stepped parts 31*a*, 31*b* of the lock groove wall 32*a* or one stepped part 31*a* is engaged with the edge of the attachment port of the panel.

Although the retainer member 30 having the foregoing structure is inserted into the attachment port of the panel, the panel, the retainer members 30*a*, 30*b* having the foregoing structure are fixedly attached to both the left and right of the back faces of the flanges 13 in the manner that the elastic retainer pieces 34, 34 face each other. Since the elastic retainer pieces 34, 34 are fixedly attached to the flanges while they face each other, even if a foreign matter impinges against the retainer members 30*a*, 30*b* from outside, the foreign matter is received by the posts 31, 31 and it does not reach the elastic retainer pieces 34, 34. As a result, there doesn't occur a case where the elastic retainer pieces 34, 34 are pressed when a foreign matter impinges against them so that the retainer stepped part 34*a* is not removed from the peripheral edge of attachment port of the panel.

Although the retainer members set forth above are columnar or conical, they are not limited to such a shape and maybe formed in an optional shape such as square pillar-shaped, or triangular pillar-shaped or the like. Further, although the receptacle proper has a flat block shape, it is not limited to this shape and may be formed of a housing having an optional shape such as cylindrical, elliptical, square and the like in a sectional area which is cut orthogonal to a direction of insertion or removal of the connector. The fixing position of the retainer members can be changed to not only left and right back face but also to an optional wall surface such as upper and lower wall surfaces or the like owing to the change of the shapes of the retaining members.

Figure 4A:
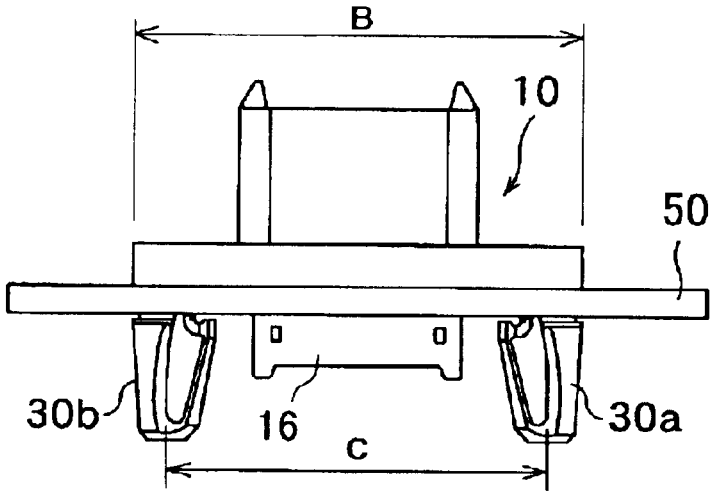
FIG. 4(A) is a plan view of a panel to which the connector of the embodiment of the invention is fitted.
Figure 4B:
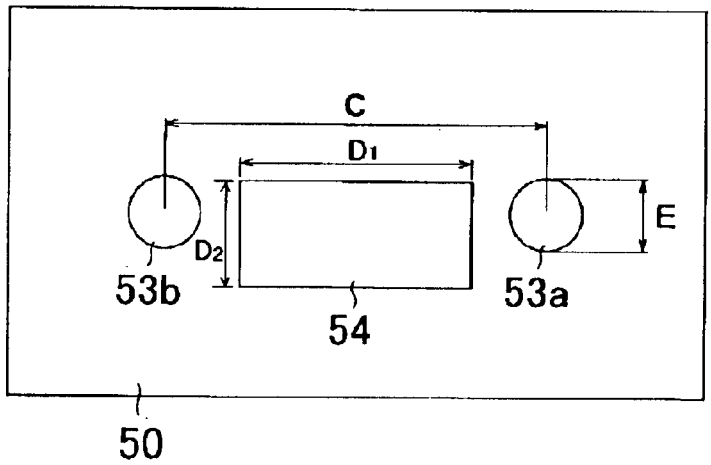
FIG. 4(B) is a front view for explaining the relationship between a receptacle 10 and the attachment port of the panel.

FIG. 4(A) is a plan view of a panel to which the connector of the embodiment of the invention is fitted. FIG. 4(B) is a front view for explaining the relationship between a receptacle 10 and the attachment port of the panel.

A panel 50 has attachment ports 53*a*, 53*b* through which two retainer members 30*a*, 30*b* are inserted, and an opening 54 through which a housing 16 is inserted is defined between the retainer members 30*a*, 30*b*. Diameters of the attachment ports 53*a*, 53*b* are slightly larger than outer peripheral diameters of the retainer bases 32, 32, wherein the retainer members 30*a*, 30*b* are freely engaged in the attachment ports 53*a*, 53*b*. Although the opening 54 is an opening through which the back housing 16 is inserted, the size of the opening 54 is set to be larger than an external shape of the back housing 16 to the extent that positioning displacement (described later) can be adjusted.

Figure 5A:
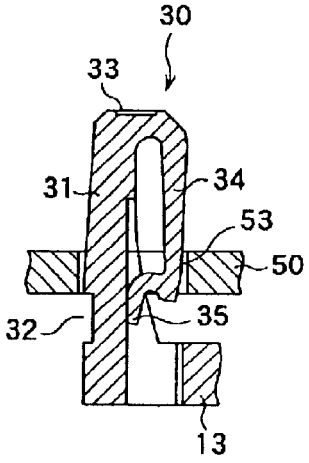
Figure 5B:
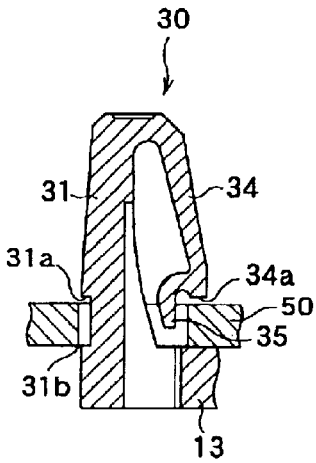
Figure 5C:
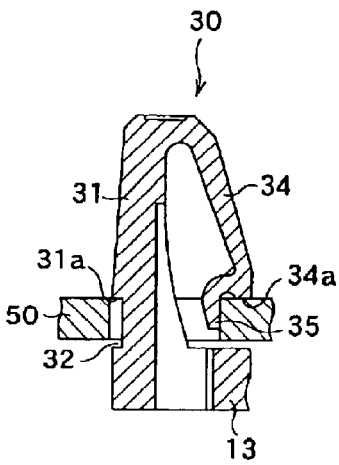

FIGS. 5(A) to 5(C) are views each showing a state where the typical retainer member in FIGS. 1(A) to 1(D) is fitted in the panel, wherein FIG. 5(A) is a sectional view showing the state during the insertion of the retainer member into the panel, FIG. 5(B) is a sectional view showing the state of the retainer member immediately after it is inserted into the panel, and FIG. 5(C) is a sectional view showing the state where the retainer member is moved after it was attached to the panel.

A method of attaching both the retainer members 30*a*, 30*b* to attachment port of the panels 53 of the panel 50 is described by use of one typical retainer member 30 with reference to FIGS. 5(A) to 5(C). Accordingly, the typical retainer member 30 is applicable to either the retainer member 30*a* or 30*b* according to the method of attachment thereof and engagement state thereof relative to the attachment port 53, wherein both the retainer members are the same in the state of attachment to the attachment port in function but merely different in the moving direction in a symmetrical manner.

When the retainer member 30 is inserted into the attachment port 53 of the panel, outer peripheral surfaces of the post 31 and elastic retainer piece 34 are butted against the edge of an opening of the attachment port 53 of the panel so that the elastic retainer piece 34 is caused to undergo flexure towards the post 31 and passes through the opening attachment port 53 of the panel. At this time, the inner surface of the tongue piece 35 impinges against the inner surface of the post 31. When the tongue piece 35 impinges against the post 31, the elastic retainer piece 34 is restricted in bending, so that there is no possibility that the elastic retainer members is damaged owing to the application of an excessive bending to the elastic retainer members (see FIG. 5(A)).

Further, when the retainer member 30 is pushed deeper into the attachment port 53 of the panel and the retainer stepped part 34*a* passes through the inner end face of the panel 50, the retainer member 30 is returned to an original state due to elastic force of the elastic retainer piece 34 and the panel 50 enters the interior of the retainer base 32 of the retainer member 30, so that the receptacle 10 is fixedly attached to the panel 50 by the retainer member 30 (see FIG. 5(C)).

The outer peripheral diameter of the retainer base 32 formed at the root of the retainer member 30 in this state is formed smaller than the diameter of the attachment port 53 of the panel so that the retainer member 30 can be freely engaged in the attachment port 53 of the panel by the difference in the diameters therebetween in a circumferential outward direction.

In a normal attachment state, the retainer base 32 is engaged with the peripheral edge of the attachment port 53 of the panel by the stepped part 31*a* of the lock groove wall and the stepped part 34*a* of the elastic retainer member so that the retainer base 32 is moved in the attachment port of the panel. Even if an engagement area of the retainer stepped part 34*a* relative to the panel 50 is reduced, the stepped part 31*a* is engaged with the peripheral edge of the attachment port of the panel by the amount of reduction of the engagement area, and hence the retainer base 32 is engaged in the attachment port of the panel while the retainer base 32 and the retainer stepped part 34*a* are complementing each other.

Meanwhile, when the retainer member 30 is moved extremely towards one side, the stepped part 31*a* is removed from the peripheral edge of the attachment port of the panel, and the engagement area is reduced, but the retainer base 32 is sufficiently engaged with the attachment port of the panel at the other retainer stepped part 34*a* by the amount of reduction of the engagement area. That is, when the retainer member is moved left and right in a normal state, the stepped part is butted against and engaged with the peripheral edge of the attachment port while the other stepped part is engaged with the peripheral edge of the attachment port, thereby increasing the engagement area relative to the face of the panel, so that stable engaging state is achieved. Further, when the retainer member 30 is moved extremely towards one side so that the stepped part 31*a* is removed from the peripheral edge of the attachment port of the panel, the other stepped part is deeply engaged with the peripheral edge of the attachment port, thereby achieving an excellent engaging state. The engaging state between the retainer member 30 and the attachment port of the panel described above can be achieved by the engagement between the retainer members 30*a*, 30*b* and the attachment ports 53*a*, 53*b*.

Figure 6C:
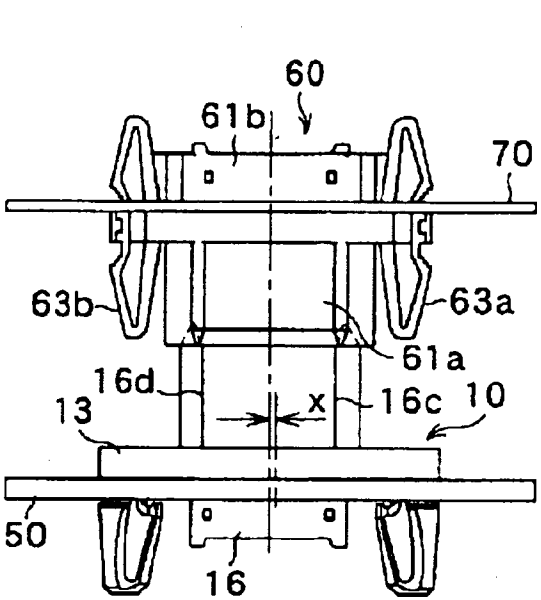
Figure 6B:
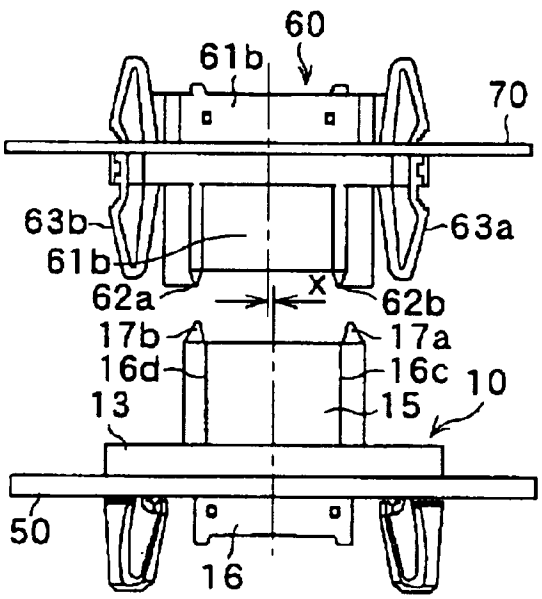
Figure 6A:
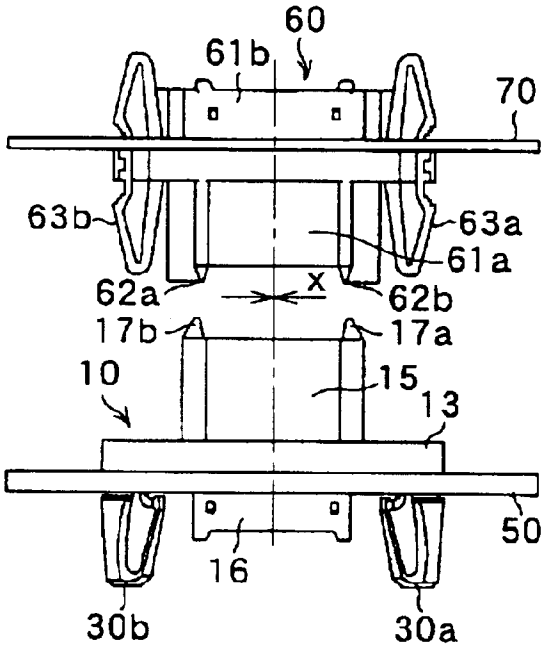
Figures 7A, 7B, 7C, 7D:
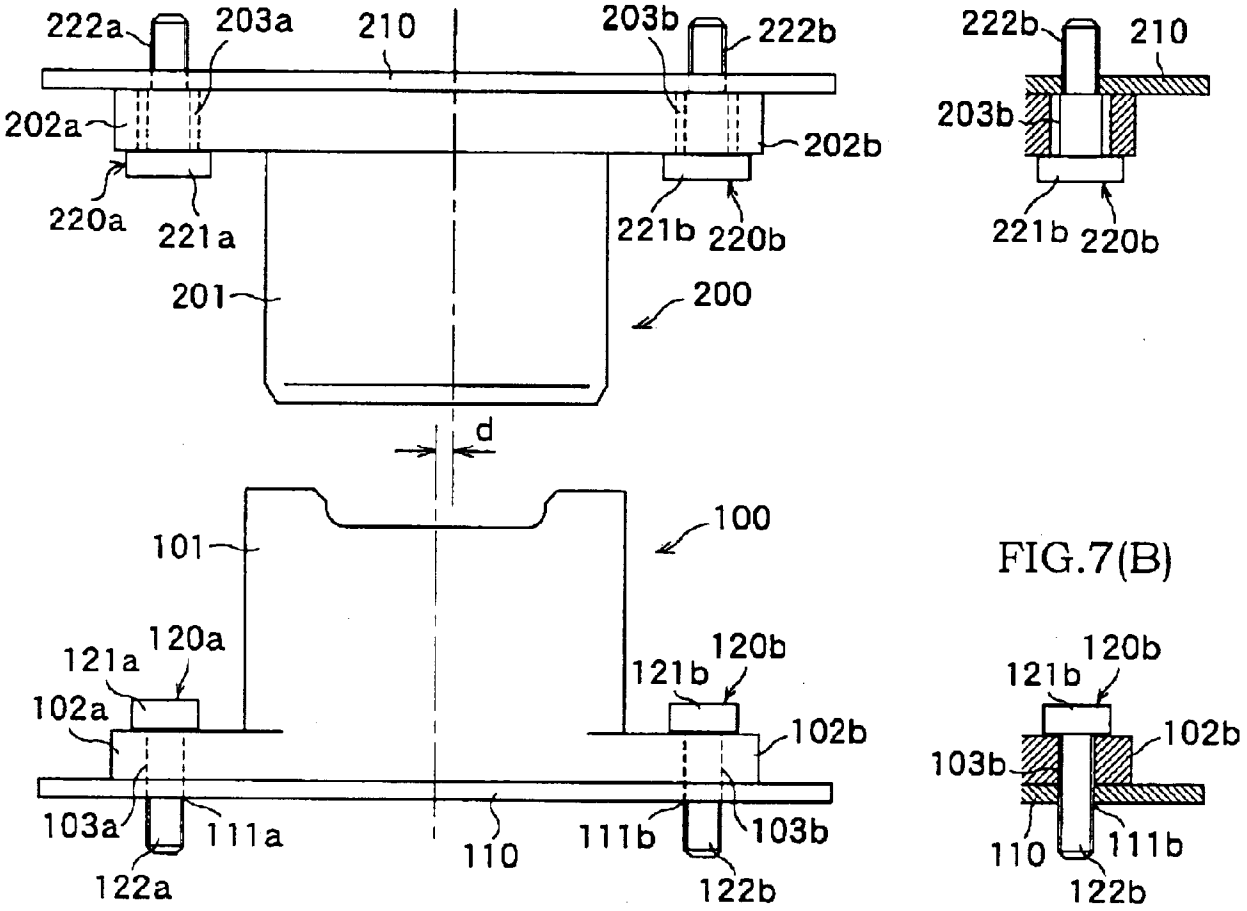
Figure 8:
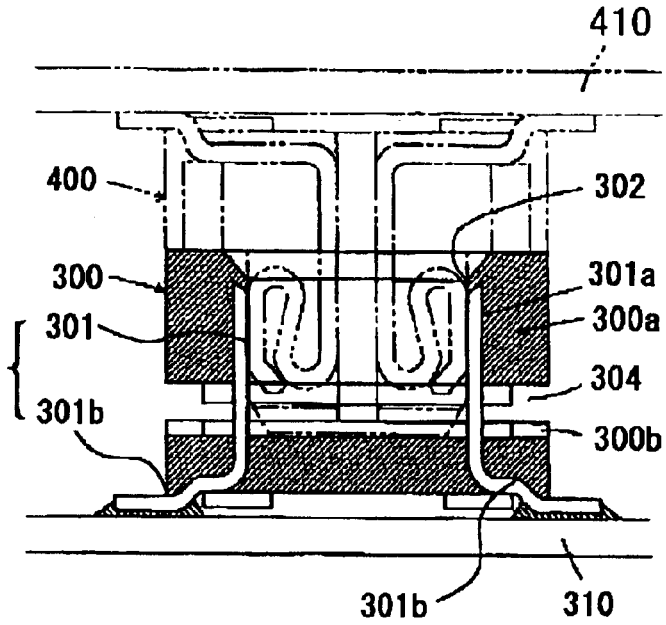
FIG. 8 is a sectional view showing the coupling between connectors in a conventional panel versus panel type connector system.
Figure 9:
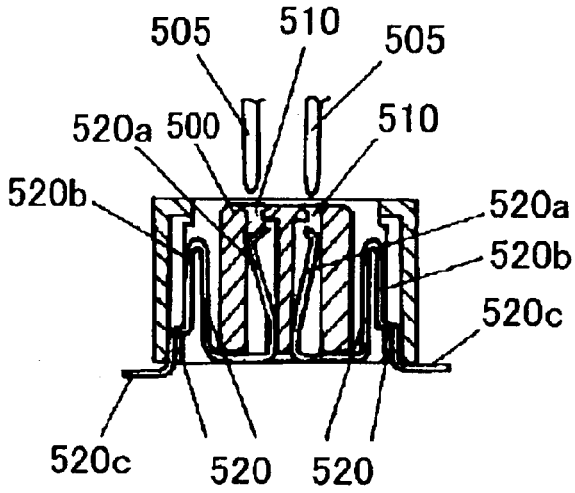
FIG. 9 is a sectional view showing a conventional method of coupling between connectors in a conventional panel which is movably attached to the panel.

FIGS. 6(A) to 6(C) are views each showing a positional relationship in a coupling state between the connector according to the embodiment of the invention and another connector, wherein FIG. 6(A) is a plan view of the positional relationship in a normal state where positional displacement does not occur, FIG. 6(B) is a plan view of the positional relationship in a state where the positional displacement occurs, and FIG. 6(C) is a plan view showing a state where the positional displacement is absorbed.

A housing proper of a plug 60 coupled with the receptacle 10 is divided at the flange, as the boundary, into a front housing 61*a* and a back housing 61*b*, and a pair of retainer members 63*a*, 63*b* are formed on both sidewalls of the housing proper. The back housing 61*b* of the plug 60 is inserted into the attachment port provided in a panel 70, and the plug 60 is firmly attached to the panel by the pair of retainer members 63*a*, 63*b*.

Described with reference to FIGS. 6(A) to 6(C) are a method of attaching the receptacle 10, for example, an eight pole receptacle having e.g., 8 connector terminals, to the panel 50 and a method of adjusting positional displacement which occurs between the receptacle 10 and the plug 60 firmly attached to another panel 70 to be coupled with the receptacle 10.

The receptacle 10 is attached to the panel 50 as shown in FIG. 4. The panel 50 has two attachment ports 53*a*, 53*b* into which retainer members 30*a*, 30*b* are inserted, and the opening 54 into which the connector terminals are inserted and which is disposed between the attachment ports 53*a*, 53*b*. The diameter of the attachment ports 53*a*, 53*b* is formed larger than the outer peripheral diameter of the retainer base of the retainer member, e.g., by about 1.2 mm.

For example, the eight pole receptacle 10 is set in dimensions such that A=10.5 mm, and B=32.5 mm, where A represents a length of center between both sides of the terminals, and B represents a lateral width of the housing proper including the flange. The panel 50 is set in dimensions such that C=27.6 mm, $D_1$=16.8 mm, $D_2$=7.7 mm, E=5.2 mm, where C represents a distance of center between the two attachment ports 53*a*, 53*b*, $D_1$ represents a lateral width of the opening 54, $D_2$ represents a vertical width of the opening 54, and E represents a diameter of the attachment ports 53*a*, 53*b*. Further, the relationship relative to the diameter E of the attachment port of the panel is set at, for example, G=4.0 mm. Where G represents the diameter of the retainer base 32.

Accordingly, when the retainer base 32 is inserted into the attachment port 53, there occurs a difference between the diameter E of the attachment port of the panel and the diameter G of the retainer base 32, namely, the expression of E−G=5.2−4.0=1.2 (mm) is established so that the retainer base 32 is freely engaged in the attachment port. Further, the other retainer base 32 is freely engaged in the attachment port in the same way, so that respective retainer bases can be moved horizontally inside respective attachment ports, for example, by 0.6 mm.

When the retainer base having an outer peripheral diameter of 4.0 mm is inserted into the attachment port having the diameter of 5.2 mm, the retainer member is freely movably engaged in the attachment port in the peripheral outward direction by the half of the difference therebetween, namely, 0.6 mm because the outer peripheral diameter of the retainer base is formed smaller than the diameter of the attachment port by 1.2 mm as described in the engaging state between the attachment port 53*b* and the retaining member 30*b*. In such a manner, the receptacle 10 is fitted in the panel 50, and the same receptacle 10 is coupled with the plug 60 which is fixedly attached to another panel. At this time, it is assumed that the plug 60 is not movable horizontally and vertically in any case shown in FIGS. 6(A) to 6(C) and firmly fixedly attached to the panel 70.

(i) In cases where positional displacement X does not occur between the receptacle and the plug (see FIG. 6(A)).

The receptacle 10 and the plug 60 are smoothly coupled with each other such that the front housing 15 of the receptacle 10 is engaged in the opening of the plug 60 while the receptacle 10 is not moved horizontally, i.e., orthogonal to the coupling direction thereof or vertically, i.e., perpendicularly to the coupling direction at the central position in the coupling direction of both the receptacle 10 and plug 60 (position show in dotted and chain line).

(ii) In cases where positional displacement X occurs between the receptacle 10 and the plug 60 in the direction orthogonal to the coupling direction thereof (see FIGS. 6(B), 6(C)).

When the receptacle 10 is inserted into the plug 60, the inclined portion 17*a*, 17*b* of the front housing of the receptacle 10 enters the chamfered surface in the vicinity of the opening of the plug 60, and the receptacle 10 is moved by the distance of the positional displacement, so that the receptacle 10 is corrected in course to a normal state, and hence both the receptacle 10 and the plug 60 are coupled with each other.

Further, even if the positional displacement X occurs in a direction opposite to the direction where the positional displacement occurs set force above, the receptacle 10 can be corrected in course in the same manner as set forth above. Still further, even if the positional displacement occurs not only horizontally, i.e., orthogonal to the coupling direction of the receptacle but also vertically, i.e., perpendicularly to the coupling direction thereof, it can be corrected in course in the same manner as set forth above.

Accordingly, since the positional displacement X occurs at both the attachment ports by the difference between the diameter E of the attachment port and that G of the retainer base, namely, E−G=5.2−4.0=1.2 (mm) is established, the maximum movement amount of the retainer base in each attachment port becomes half of the difference, namely, the retainer base is movable by 0.6 mm. This movement amount is corrected in course and becomes the absorption amount.

With the connector with retainer members having the foregoing structure according to the invention, the elastic retainer pieces of the retainer members are not broken when they are fitted into the panel, even if they are excessively bent.

Further, a stress is not inadvertently applied to the elastic retainer pieces of the retainer members. As a result, it is possible that the elastic retainer pieces are not permanently deformed or broken, and also the retainer stepped parts of the elastic retainer pieces are prevented from being removed from the peripheral edge of the attachment port of the panel.

Still further, the connector with retainer members can be fitted in the panel while ensuring strength and stability not to remove from the panel.

More still further, when the connector is fitted to another connector which is fixedly attached to the panel, they can be connected to each other without laboring while the error of the attachment positions of the panels which occurs between both the connectors can be automatically adjusted.

What is claimed is:

1. A connector to be attached to a panel having attachment ports with peripheral edges; the connector comprising:

an insulating housing proper having a plurality of connector terminals fitted therein;

the housing comprising flanges protruded outwardly from right and left or upper and lower wall faces of the housing proper in a direction orthogonal to a direction of insertion and removal of the connector;

a pair of retainer members having elasticity and fixedly attached to the flanges secured to both sides of the back face of the flanges;

wherein said retainer member comprise posts fixedly attached to the flanges, and elastic retainer pieces having flexibility and folded back in an inverted V-shape from each head thereof, and wherein said elastic retainer pieces comprise retainer stepped parts comprising tip ends to engage at the peripheral edge of the attachment ports of the panel, and tongue pieces disposed at respective tip ends of the retainer stepped parts, and wherein the tongue pieces extend laterally inward from a side of the elastic retainer pieces facing a respective one of the posts to butt against the posts, when forced toward the posts, for restricting the tip ends from being excessively bent toward the posts.

2. The connector according to claim 1, wherein the retainer members are made up of retainer bases comprising lock grooves having diameters which are smaller than those of attachment ports of the panel and widths which are wider than a thickness of the panel, and retainer stepped parts of the elastic retainer pieces respectively at fixed roots of the flanges.

3. The connector according to claim 1, wherein the retainer members are fixedly attached to the flanges in a manner that the elastic retainer pieces face each other while the posts sandwich the housing proper therebetween.

4. A method for attaching a connector with retainer members to be attached to a panel to another panel comprising the steps of:

preparing the connector as in any of claims 1 to 3, and a panel having attachment ports slightly larger than a diameter of an outer periphery of the retainer members of the connector;

wherein when the retainer members are inserted into the attachment ports of the panel against the urging of elastic force thereof, the retainer bases of the retainer members are freely engaged in the attachment ports of the panel, whereby the retainer bases are engaged with peripheral edges of the attachment ports of the panel at stepped parts of the lock groove walls and stepped parts of the elastic retainer pieces.

5. A method of coupling a connector attached to a panel by the method according to claim 4 to another connector fixedly attached to another panel, in cases where positional displacement occurs between both connectors when both connectors are coupled with each other, the connector is coupled with another connector fixedly attached to another panel in a state where the retainer bases of the connector are freely engaged in the attachment ports of the panel, so that the retainer bases are movable in the attachment port by an interval corresponding to a difference in diameter between the attachment port of the panel and the outer periphery of the retainer bases, thereby absorbing the positional displacement between both connectors.

6. The connector according to claim 2, wherein the lock groove and the attachment port are round.

7. The method according to claim 4, wherein the lock groove and the attachment port are round.

8. The method according to claim 5, wherein the lock groove and the attachment port are round.

9. The connector according to claim 1, wherein the elastic retainer pieces and the tongue pieces form a jogged shape in cross section.

* * * * *